United States Patent [19]

Frezza

[11] 4,183,151

[45] Jan. 15, 1980

[54] HIGH PRODUCTION STEAMER FOR TUBULAR KNITTED FABRIC OR THE LIKE

[75] Inventor: Robert Frezza, New York, N.Y.

[73] Assignee: Samcoe Holding Corporation, Woodside, N.Y.

[21] Appl. No.: 848,101

[22] Filed: Nov. 3, 1977

[51] Int. Cl.[2] ..... D06B 3/20

[52] U.S. Cl. ..... 34/155; 8/149.3; 26/81; 34/160; 68/5 D

[58] Field of Search ..... 34/72, 57 R, 150, 155, 34/160, 242; 8/149.3; 26/56, 81; 68/5 D, 5 E, 6; 226/44

[56] References Cited

U.S. PATENT DOCUMENTS

| | | | |
|---|---|---|---|
| 2,602,314 | 7/1952 | Cohn et al. | 68/6 |
| 3,065,551 | 11/1962 | Cohn et al. | 26/81 X |
| 3,484,949 | 12/1969 | Aronoff | 26/81 X |
| 3,868,215 | 2/1975 | Frezza | 8/149.3 |
| 3,875,624 | 4/1975 | Frezza | 26/56 |
| 3,971,235 | 7/1976 | Frezza | 34/160 X |

*Primary Examiner*—Louis Rimrodt
*Attorney, Agent, or Firm*—Mandeville and Schweitzer

[57] ABSTRACT

A high production steamer for tubular knitted fabrics or the like which comprises means for distending and conveying the fabric along a predetermined, generally horizontal processing plane and a pair of steam boxes mounted in opposed relation, one above and one below the processing plane. The steam boxes are of a heretofore known dripless construction which includes discharge openings extending across the width of the fabric and arranged to direct steam toward the upper and lower faces of the fabric. According to the invention, a novel steam confining means is provided to confine the discharged steam to a limited region closely surrounding the fabric. The confining means comprises a chamber formed by wall-forming members associated with the discharge sides of the steam boxes and the end plates of the opposed steam boxes which are arranged in a contacting relation along the sides of the path of conveyance for the fabric. To advantage, the steam confining means will facilitate an effective steam penetration of the fabric in a relatively short time period. Means are also provided to heat the upper regions of the steam confining means to prevent condensation of the discharged steam above the processing plane.

12 Claims, 6 Drawing Figures

HIGH PRODUCTION STEAMER FOR TUBULAR KNITTED FABRIC OR THE LIKE

BACKGROUND AND SUMMARY OF THE INVENTION

The present invention relates to the steaming of tubular knitted fabrics in finishing operations and particularly to an improved apparatus for the application of dry steam to both sides of the fabric simultaneously.

In the processing of tubular knitted fabric it is conventional practice to direct the tubular fabric over an internal spreading device, often referred to as a spreader or propeller. The device distends the fabric laterally to a predetermined uniform width, typically advancing the fabric by means of longitudinally moving belts engaging the inner edge walls of the fabric. While the fabric is held in its laterally distended condition, and while it is being advanced through the finishing equipment, it is subjected to a steaming operation, to relax the fibers and enable the fabric to readjust to its laterally distended, geometrically uniform condition. To a large extend, the fabric then tends to retain this geometric condition when it is delivered at the discharge end of the spreading device.

Typically, the distended fabric is conveyed and steamed while the fabric occupies a horizontal plane. Consequently, it is necessary to avoid condensation on the portions of the finishing equipment located directly above the fabric being processed. Otherwise, the condensed water would eventually drip down upon the face of the fabric causing water spots and thereby greatly detract from the value of the processed fabric.

In accordance with well known principles, the condensation problem is substantially eliminated by providing a steam discharge means comprising a steam pipe enclosed by a steam discharge housing. The pipe includes longitudinally spaced perforations to permit the escape of steam into the confines of the housing. The housing generally comprises an inner channel member having legs and an outer channel member having legs partially enclosing the inner channel member. The legs of the inner channel member have inturned ends forming baffles and the legs of the outer channel member have inturned ends in a parallel, spaced relation to the legs of the inner channel member forming therewith slots for the escape of steam. Means are provided for withdrawing condensation from within the housing. The above-described arrangement is extremely effective in removing condensation caused by the partial cooling of the steam as it expands upon discharge from the steam pipe. Moreover, the pressure of the steam within the outer channel member is higher than the steam passing through the slots, thereby maintaining the slots at a sufficiently high temperature to prevent the formation of droplets of water in the slots. Consequently, only dry steam will be discharged to the upper surface of the fabric being processed and the fabric will be steam treated without the danger of water-spotting.

It is an important goal of the tubular knit fabric manufacturing industry to increase the overall rate of production for the fabric. Yet, the speed of a typical finishing process is generally limited by the ability to effectively impart steam to the fabric. Merely increasing the rate of steam application, using conventional equipment, has been found to be ineffective inasmuch as greater volumes of steam give rise to unwanted condensation problems notwithstanding the utilization of the above-described dripless steam discharge arrangement. This is due to the fact that the higher rates of steam flow cause condensation problems after the steam is issued from the steam boxes.

An advantageous process for steaming the fabric while increasing the rate of production is disclosed in the Frezza U.S. Pat. No. 3,868,215. In accordance with the teachings of the Frezza patent, the discharged steam is generally confined around the path of conveyance for the fabric. The confinement of the steam in contact with the fabric immediately following its issuance from the steam box, greatly enhances the ability of the steam to achieve the desired levels of penetration of the fabric within a short period of time. As a result, it is possible to significantly increase the speed of passage of the fabric.

A primary objective of the present invention is to further improve the overall rate of production for the fabric by providing a novel and improved apparatus for discharging steam in a dry condition and confining it to the immediate vicinity of the path of conveyance for the fabric and further providing means to prevent condensation of the discharged steam within the confining structure. Generally, a pair of steam boxes of the above-described type are mounted in an opposed relation on opposite sides of the plane occupied by the fabric to be processed. In accordance with a significant aspect of the invention, a wall-forming member is mounted on the discharge side of each of the steam boxes and extends in both the downstream and upstream directions of the path of fabric conveyance. Moreover, the opposed steam boxes are provided with end plates arranged in a close-fitting relation to one another along the sides of the conveyance path. Significantly, the contacting end plates and wall-forming members define a steam confining chamber closely surrounding the spreader and fabric. The chamber is arranged to form a zone not substantially greater in height at any given point than the distance from the steam discharge ducts to the fabric surface. Accordingly, a highly effective steam penetration is achieved in a relatively short time period.

The improved arrangement for the steam box provides, in an efficient, straightforward manner, a construction to achieve the desired steam confining capabilities with a structure that lends itself to easy and inexpensive manufacture. Moreover, the disclosed steam box is of compact design and therefore occupies a minimum of space to permit the most effective utilization of a factory production area.

In accordance with another important feature of the present invention, the wall-forming member of the upper steam box includes means for heating the surface thereof. In a preferred form, the heating means comprises a plate which is co-extensive with the wall-forming member and securely mounted thereon. The plate is provided with a passage-forming means whereby high pressure steam may be circulated across the surface area of the plate to maintain the upper regions of the steam confining chamber at a sufficiently high temperature to prevent the formation of droplets of condensed water.

To accommodate the passing through of the fabric being processed, the steam apparatus of the invention includes a series of hinged, relatively narrow flap elements at the entry and exit openings of the steam confining chamber. The hinged flap elements are mounted on the front and rear edges of the wall-forming member of the upper steam discharge box. Magnetic elements are carried by the flap elements or by a wall-forming member of the lower steam box whereby the hinged elements normally will be held in a closed condition by magnetic attraction. The machine operator opens a sufficient member of the hinged elements to accommodate the width of the particular fabric being conveyed through the steaming apparatus. The remaining hinged elements are kept closed to act as confining elements for the steam chamber. The magnetic attraction of the flaps is sufficiently strong to prevent steam pressure, within the steam confining chamber, from opening the hinged elements.

The disclosed steaming apparatus provides a highly effective means for discharging dry steam toward both surfaces of a fabric and for effectively confining the steam in the vicinity of the fabric to greatly increase the rate of production for the processing of the fabrics. The wall-forming members define a processing chamber of minimum volume, sufficient to enclose the fabric and spreader while minimizing the volume of confined steam. Moreover, by heating the upper wall-forming member of the chamber any problem with diverted steam, condensation of steam over the fabric is avoided.

For a better understanding of the above and other features and advantages of the invention, reference should be made to the following detailed description and the accompanying drawings.

DETAILED DESCRIPTION OF PREFERRED EMBODIMENTS OF THE INVENTION

Figure 4:
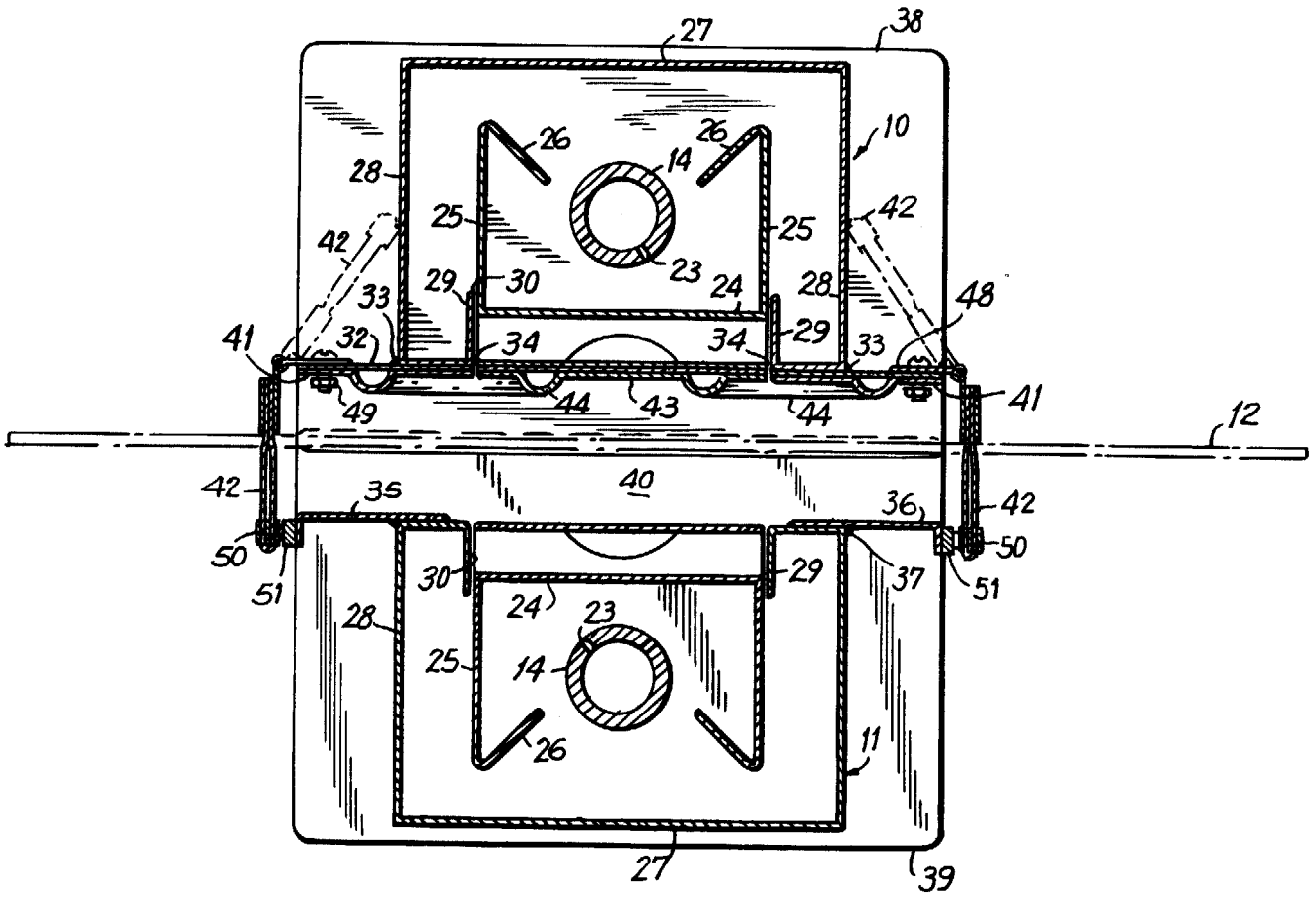
FIG. 4 is a cross-sectional view of the steam apparatus as taken generally on line 4—4 of FIG. 2.

Referring now to the drawings and initially to FIG. 4 thereof, a pair of steam discharge boxes 10, 11 are arranged in an opposed relation above and below a path of conveyance for a tubular knitted fabric 12. The fabric 12 is distended and conveyed by a conventional propeller spreader apparatus (not shown), as for example a spreader of the type utilized in the apparatus for finishing tubular knitted fabric disclosed in Frezza U.S. Pat. No. 3,875,624. The spreader is arranged to laterally distend the fabric 12 to a flat, two-layered form, at a predetermined, uniform width. As part of the finishing operation, the steamers 10, 11 discharge steam onto the upper and lower layers of the distended fabric 12 in a generally known manner. The steaming allows the fabric 12 to readjust to its laterally distended, geometrically uniform conditions.

In general, the steam boxes 10, 11 are constructed in accordance with the teachings of the Cohn et al. U.S. Pat. No. 2,602,314. Each steam box 10, 11 includes a steam pipe 14 suitably connected through a common manifold connecting pipe 18, valve 15 and pressure reducing valve 16 to a main steam line 17. The ends of the pipes 14 extend beyond the ends of the steam boxes 10, 11 and are supported by mounting brackets plate 20, 22. A throttling orifice 19 may be provided to reduce the rate of flow of steam. The ends of the steam pipes 14 opposite the manifold 18 are dead ended by caps 21. Each pipe 14 includes openings 23 to permit the steam to escape within the respective steam boxes 10, 11.

An inner channel member 24 includes side walls 25 with reversely turned baffle-forming flanges 26. The openings 23 of the pipe 14 are arranged to face the internal portions of the inner channel member 24. An outer channel-shaped housing member 27 has side walls 28 with reversely turned flanges 29 which are slightly spaced from the side walls 25 of the inner channel member 24 to form elongated steam discharge slots 30 extending across the width of the steam boxes.

In the operation of the steam discharge boxes 10, 11, as the steam is discharged through the openings 23 into the inner channel member 24, it follows a path up and around the side walls 25 and baffle flanges 26 into the chamber defined by the walls 25 and 28. The steam is then discharged from the box 10, 11 at relatively high velocity through the discharge slots 30 and toward the surface of the conveyed and distended fabric 12. Any condensate resulting from the partial cooling and expansion of the steam as it escapes from the pipe 14 will collect on the walls 25 and baffle flanges 26 and drawn to the bottom of the inner channel member 24. Likewise, any condensate forming within the outer housing member 27 will collect at the bottom of the housing member 27. Condensation drains 31 communicate with the internal portions of the housing members 27 to allow the condensed steam to be removed from the steaming apparatus.

In accordance with the invention, the discharge end of the upper steam box 10, is provided with an elongated wall-forming member 32. The member 32 may be welded to the lower extremities of the housing side walls 28, as reflected at 33, and extends in the upstream and downstream direction of the path of conveyance for the fabric 12. A pair of slots 34 are formed in the member 32 transverse to the direction of fabric 12 travel and in communication with the discharge slots 30 of the steam box 10.

In a similar manner, the discharge end of the lower steam box 11 is provided a pair of wall-forming plate extensions 35, 36 welded to the lower housing member 27, as reflected at 37. The plate extensions 35, 36 extend in the upstream and downstream direction of the fabric path respectively. As can be clearly seen in FIG. 4, the member 32 occupies a plane spaced above and parallel to the fabric plane and the plate extensions 35, 36 occupy a common plane spaced below and also parallel to the fabric plane. This provides two longitudinally extending walls above and below the fabric path of conveyance.

Figure 1:
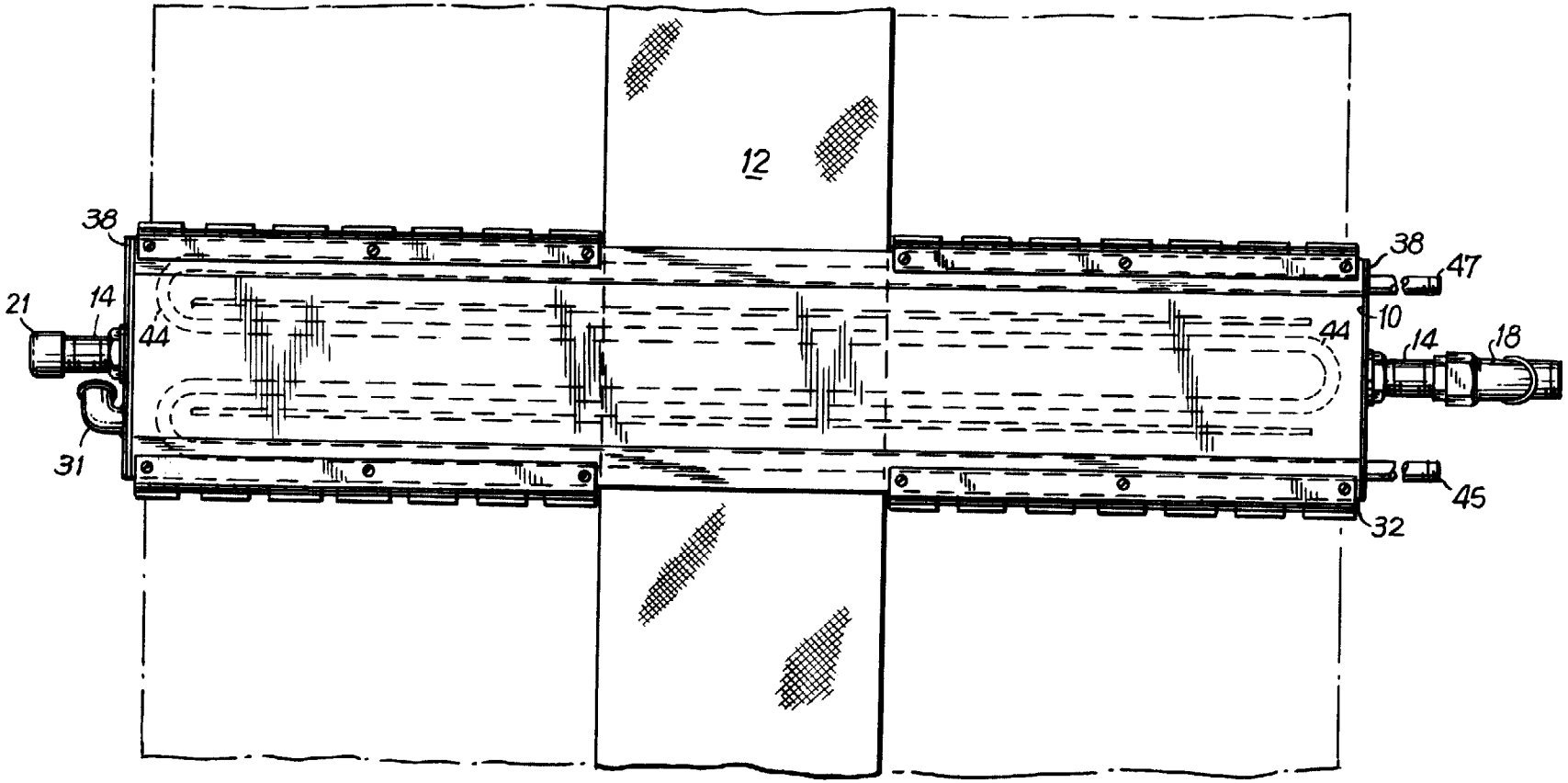
FIG. 1 is a top plan view of a steam apparatus constructed in accordance with the teachings of the invention.
Figure 2:
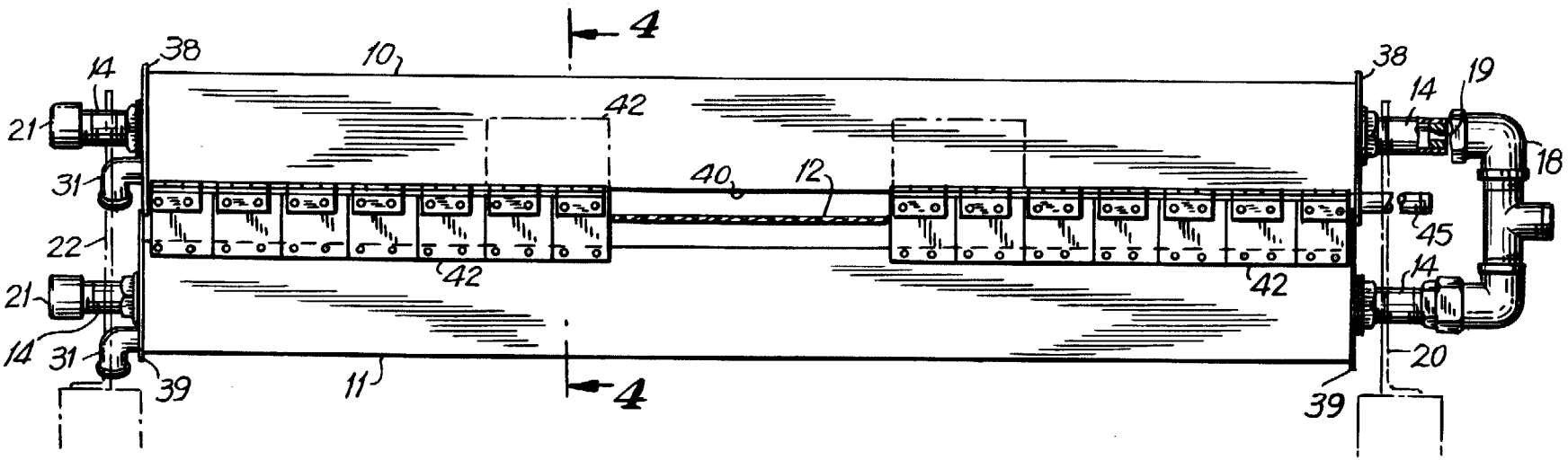
FIG. 2 is an end view of the steam apparatus of FIG. 1.

Referring now to FIG. 2, each of the steam boxes 10, 11 includes a pair of end plates 38, 39 respectively. The end plates 38, 39 of opposed boxes 10, 11 are arranged to contact one another in an overlapping relation thereby forming longitudinally extending end walls on either side of the spreader. As can be readily appreciated, the arrangement of overlapping end plates 38, 39 and wall-forming means 32, 35, 36 at the discharge sides of the boxes 10, 11 will define a four-walled steam confining chamber 40 tightly enclosing the space between the boxes 10, 11 occupied by the spreader and distended fabric 12. The height of the chamber 40 is not significantly greater than necessary to freely accommodate the thickness of the spreader and fabric. In a typical case, a height of about 5 centimeters is appropriate for a line capable of processing tubular widths of up to, for example, 150 centimeters. A typical length of such a chamber, in the direction of fabric movement, may be on the order of 22 centimeters. The close-confining chamber 40 greatly increases the effectiveness of steam penetration and thereby permits a faster rate of travel for the fabric 12 (and hence a greater rate of production).

In accordance with another feature of the invention, a steam passage-forming plate 43 is securely attached to the wall-forming member 32 of the upper steam box 10. The plate 43 includes a continuous groove 44 which extends in a weaving path across the surface of the plate 43. When the plate 43 is secured to the member 32, the groove 44 is arranged to overlie the face of the member 32 to form a flow path for the passage of high pressure steam. One end of the groove 44 is in communication with an inlet pipe 45 connected through a valve 46 and the pressure-reducing valve 16 to the main steam line 17. The other end of the groove 44 is connected to an outlet pipe 47. High pressure steam is then circulated through the flow path formed by the continuous groove 44 and member 32. This will maintain the temperature at the upper regions of the steam confining chamber 40 sufficiently high to prevent condensation of the discharged steam above the conveyed fabric 12.

Figure 3:
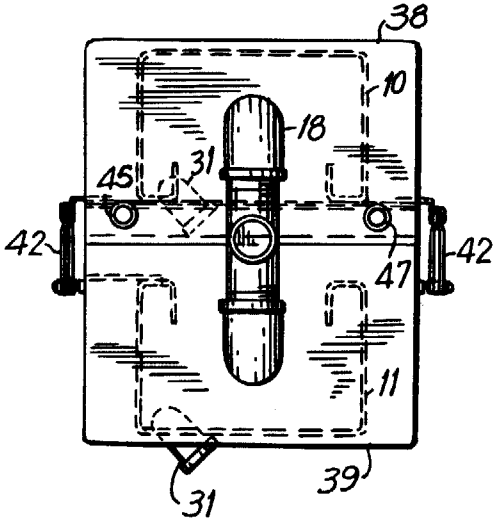
FIG. 3 is a side view of the steam apparatus of FIG. 1.
Figure 6:
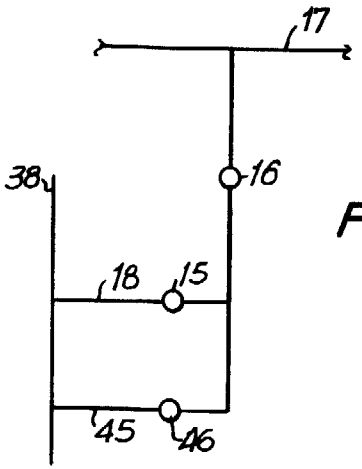
FIG. 6 is a schematic diagram for the steam delivery system used in connection with the steamer apparatus of the present invention.

In accordance with a specific aspect of the invention, the entry and exit openings 41 formed by the steam confining chamber 40 are provided with a plurality of hinged flaps 42 spaced thereacross. Each of the flaps 42 is hingedly attached at one end thereof to a leg 48, which is secured to the wall-forming member 32 and plate 43, as by bolts 49. The free ends of each flaps 42 are provided with magnetic or magnetically attractable elements 50 which cooperate magnetically with elements 51 mounted at the end edges of the plate extensions 35, 36 of the lower steam box 11. The magmetic attraction of the elements 50, 51 keeps the flaps closed notwithstanding the slight internal steam pressure which developes during normal operation of the apparatus. As can be seen in FIGS. 3 and 4, a predetermined number of the flaps 42 are opened in accordance with the width of the fabric being processed. The remaining flaps 42 are closed to minimize escape of steam to the atmosphere. The central portion of the opening 41 is not provided with flaps 42 inasmuch as there is a practical limit to the minimum width for commercially produced tubular knitted fabrics.

Figure 5:
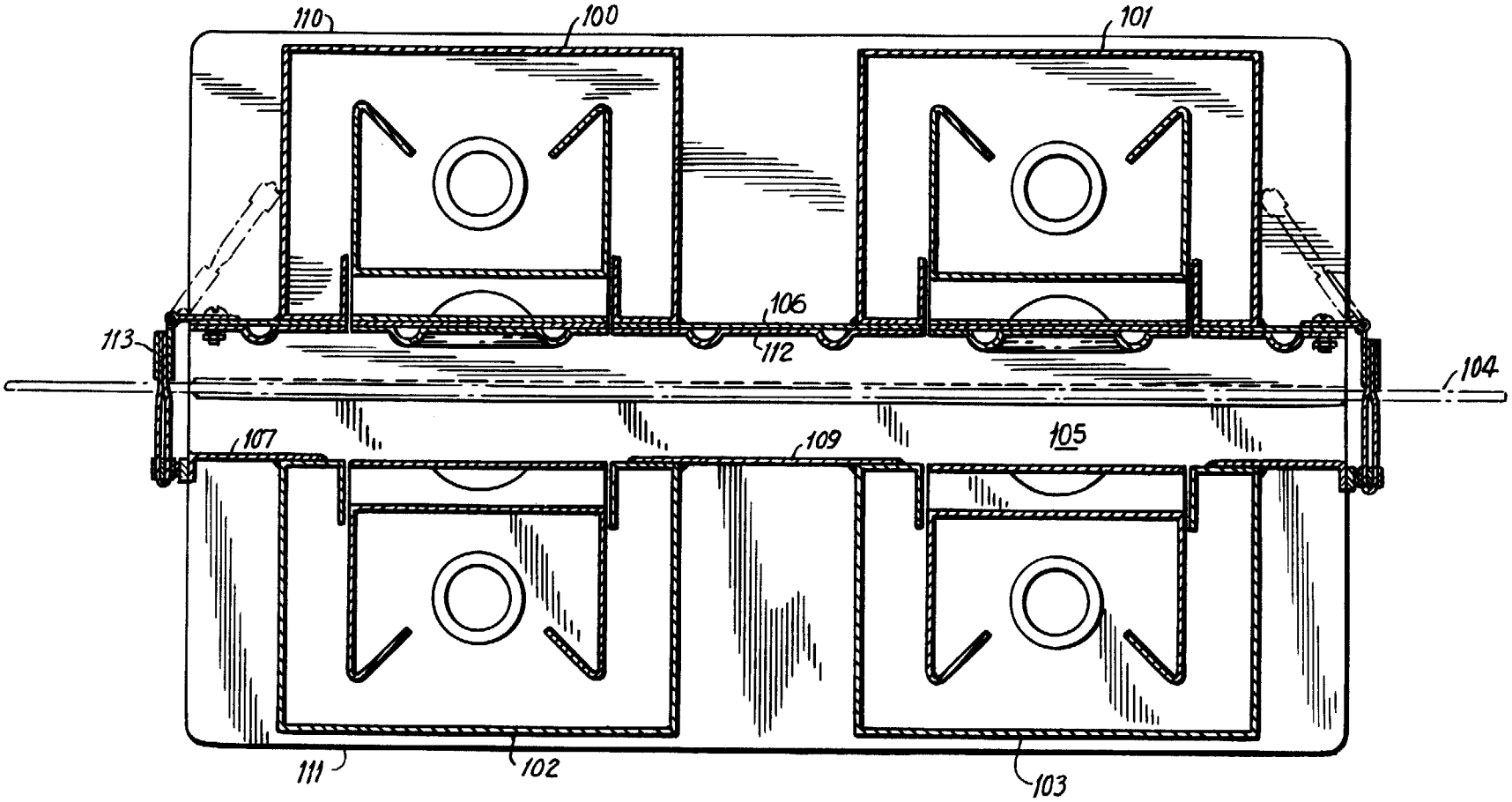
FIG. 5 is a cross-sectional view of another embodiment for a steam apparatus constructed in accordance with teachings of the invention.

Referring now to FIG. 5, there is illustrated another advantageous embodiment for a steaming apparatus built in accordance with the present invention. There is provided an adjacent pair of steam boxes 100, 101, 102, 103 above and below the path of conveyance for the fabric 104. As in the prior embodiment each of the steam boxes is of "dripless" construction, and the fabric 104 is distended and conveyed by a conventional spreader (not shown).

An elongated, upper wall-forming member 106 is attached to the discharge side of each of the upper steam boxes 100, 101 to form a continuous upper wall. Extension plates 107, 108 are mounted at the ends of the discharge sides of the lower steam boxes 102, 103 respectively and a connecting plate 109 is mounted to both lower steam boxes 102, 103 to form, with the boxes 102, 103, a continuous lower wall. A single end plate 110 is provided for the upper boxes 100, 101 at each end thereof and is in an overlapping relation to a similar pair of end plates 111 for the lower boxes 102, 103.

As in the prior embodiment, the arrangement of overlapping end plates 110, 111 and wall-forming members 106, 107, 108, 109 provides a narrow steam-confining chamber 105 closely surrounding the spreader and fabric 104. The height and width dimensions of the chamber 105 may correspond generally to those of the chamber 40 (i.e. about 5 cm × 150 cm), but the length is substantially greater, for example around 95 centimeters. The apparatus of FIG. 5 also includes a steam passage-forming plate 112 and hinged flap arrangement 113 which function in the same manner as their counterparts in the embodiment of FIGS. 1–4. To advantage, the double steamer arrangement provides an elongated path for steam treatment of the fabric 104 with the same straightforward, compact design as the above-described single steamer.

In all its various embodiments, the present invention provides an extremely efficient steaming apparatus for the finishing of tubular knitted fabrics. Significantly, the discharged steam is closely confined to the narrow zone immediately surrounding the fabric by a structure that is simple in construction and convenient and economical to manufacture. The new apparatus insures that an effective penetration occures in a short period of time.

The construction of the new steaming apparatus includes convenient provision for the circulation of steam along the upper wall of the steam confining chamber 105, greatly reducing the possibility for any undesirable condensation occurring above the fabric plane. The present invention therefore greatly increases the overall rate of production for the fabric and in a manner to insure a high quality finished product.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A high production processing steamer for tubular knitted fabrics or the like, comprising (a) a path of conveyance for the fabric being disposed in a generally horizontal processing plane, (b) a pair of steam boxes mounted in opposed relation above and below the processing plane, (c) said steam boxes having steam discharge openings at one side thereof in close proximity to and extending across the width of the fabric and arranged to direct steam toward the fabric from above and below, (d) wall-forming means associated with and located near the discharge side of each steam box and extending in the upstream and downstream directions of the path of conveyance in planes above and below the processing plane, (e) said planes above and below the processing plane each being generally parallel to and in close proximity to said processing plane, and (f) each of said steam boxes includes transversely elongated end plates sealing the outer ends thereof and extending in planes at a large angle to the processing plane on either side of the path of conveyance, (g) each of the end plates of the steam box above the processing plane being in a close-fitting relation to the complementary end plates of the steam box below the processing plane to form walls extending close to and on either side of the path of conveyance, (h) each of the end plates contacting at least a portion of at least one of said wall-forming means to define continuous, enclosing wall structures, (i) whereby said wall-forming means and said end plates are arranged and configured to form a chamber to confine steam ejected from the steam boxes to a limited region closely surrounding the fabric.

2. The processing steamer according to claim 1, further characterized by (a) the end plates of the steam box above the processing plane being in an overlapping relation to the complementary end plates of the steam box below the processing plane.

3. The processing steamer according to claim 1, further characterized by (a) the discharge side of the steam box above the processing plane including a plate-like member fixedly mounted thereon in a spaced, parallel relation to said processing plane and extending over portions of the path of conveyance upstream and downstream thereof, and (b) said plate-like member including means to heat the surface thereof to minimize steam condensation.

4. The processing steamer of claim 3, further characterized by (a) said heating means comprising a steam passage-forming means whereby high pressure steam may be circulated across the surface of said plate-like member thereby heating the surface.

5. The processing steamer of claim 4, further characterized by (a) a second plate-like member mounted in a confronting relation to the beforementioned plate-like member, (b) said second plate-like member including a continuous channel confronting said beforementioned plate-like member to form a steam flow path, and (c) means for ingress and egress of steam to said flow path.

6. The processing steamer of claim 1, further characterized by (a) said steam confining chamber having transversely elongated slit-like openings in its upstream and downstream sides to accommodate the passage of the fabric being processed, and (b) sealing means for selectively closing off portions of said slit-like openings.

7. The processing steamer of claim 6, further characterized by (a) said sealing means comprising a plurality of flap elements spaced across said slitlike openings and selectively operable to permit passage of said fabric in accordance with the fabric width, (b) said flap elements being connected at one end thereof to the steam box above the processing plane by a hinged element, (c) said flap elements including a first element having magnetic properties at the other end thereof, and (d) the steam box below the processing plane including a second element having magnetic properties whereby said flap elements are held in a closed condition by magnetic attraction between said first and second magnetic elements.

8. A high production steamer for tubular knitted fabric or the like, comprising (a) a path of conveyance for the fabric being disposed in a generally horizontal processing plane, (b) steam discharge means for directing high velocity jets of steam toward said processing plane and into the fabric being conveyed therealong, (c) said steam discharge means being arranged above and below said processing plane, and having portions in close proximity thereto, and (d) confining means comprising elongated wallforming members mounted directly on said steam discharge means at portions of the steam discharge means in close proximity to the processing plane and arranged and configured to extend laterally and transversely from the steam discharge means to thereby form a steam confinement region above and below the processing plane, along the sides of said path of conveyance and immediately upstream and downstream of the steam discharge means.

9. The processing steamer according to claim 8, further characterized by (a) said steam discharge means including end plates in a sealing relation thereto and occupying planes at large angles to said processing plane, and spaced on either side of said path of conveyance, and (b) said elongated wall-forming members comprising integral extensions of said end plates extending on either side of said path and plate-like members occupying planes above and below the processing plane and secured to the portions of the steam discharge means in close proximity to said processing plane.

10. The processing steamer according to claim 9, further characterized by (a) the plate-like member occupying the plane above said processing plane including means to heat the surface thereof to minimize condensation.

11. The processing steamer according to claim 8, further characterized by (a) said steam discharge means comprising a first pair of steam boxes positioned above the processing plane and a second pair of steam boxes each in an opposed relation to a complementary one of the first pair of steam boxes and positioned below the processing plane.

12. The processing steamer according to claim 11, further characterized by (a) said elongated wall-forming means comprising a first plate mounted to the steam discharge side of each of the pair of steam boxes above the processing plane, a second plate extending between and mounted to each of said second pair of steam boxes and third and fourth plates, each being mounted to one of said second pair of steam boxes and extending in the upstream and downstream direction of the path of conveyance, respectively, and (b) said first plate including means to heat the surface thereof to minimize condensation.

* * * * *